US005765430A

United States Patent [19]

Iihara et al.

[11] Patent Number: 5,765,430

[45] Date of Patent: Jun. 16, 1998

[54] METHOD FOR AND APPARATUS OF PRODUCING OUTER MEMBER OF UNIVERSAL JOINT HAVING CROSS-GROOVES

[75] Inventors: Michio Iihara, Hamamatsu; Yasushi Takahara; Yoshihiro Sagisaka, both of Iwata, all of Japan

[73] Assignee: NTN Corporation, Osaka, Japan

[21] Appl. No.: 715,326

[22] Filed: Sep. 18, 1996

[30] Foreign Application Priority Data

Sep. 27, 1995 [JP] Japan ..... 7-249425
Jul. 17, 1996 [JP] Japan ..... 8-187807

[51] Int. Cl.[6] ..... B21D 22/00

[52] U.S. Cl. ..... 72/353.4; 72/358

[58] Field of Search ..... 72/344, 345, 353.4, 72/353.6, 354.2, 358, 359, 398

[56] References Cited

U.S. PATENT DOCUMENTS 5,186,082 2/1993 Kuramitsu et al. ..... 72/353.4

FOREIGN PATENT DOCUMENTS 63-224833 A 9/1988 Japan ..... 72/353.4
1-104441 A 4/1989 Japan ..... 72/353.4

*Primary Examiner*—Lowell A. Larson
*Assistant Examiner*—Rodney A. Butler
*Attorney, Agent, or Firm*—Nikaido, Marmelstein, Murray & Oram LLP

[57] ABSTRACT

A method for and an apparatus of producing an outer member of a universal joint having cross-grooves are provided in order to increase replenishability of the inner peripheral portion of the outer member. The outer member 1 is provided in a preformed material including a shaft 1*a* and a cylindrical portion 1*b*. A punch set 5 is fitted within the cylindrical portion 1*b*. The punch set is expandable and constrictable in the radial direction and includes a plurality of protrusions 3 having a configuration complementary to that of the cross-grooves. The cylindrical portion 1*b* is pressed into a die bore 8, starting with its opening portion 9, for performing an ironing operation.

6 Claims, 7 Drawing Sheets

FIG.1(A)
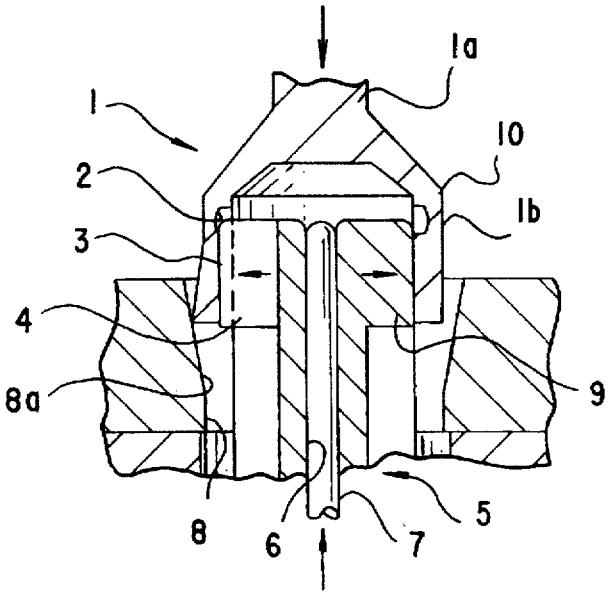
FIG.1(B)
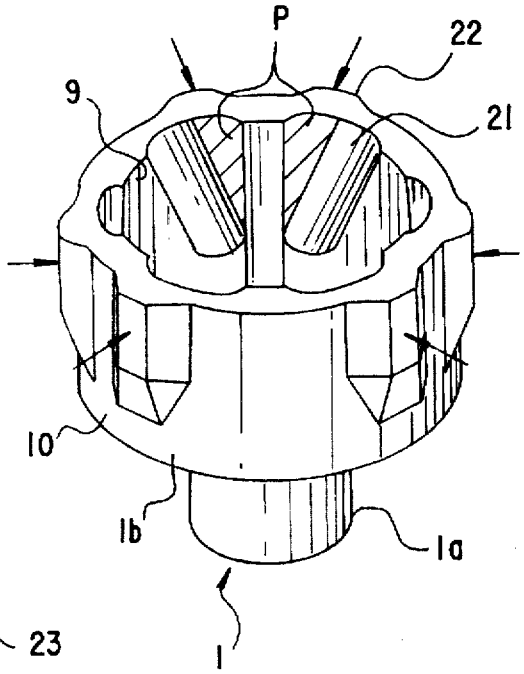
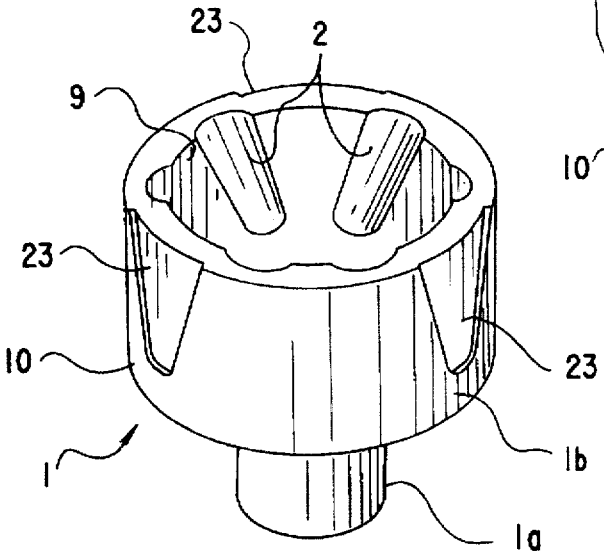
FIG.1(C)

METHOD FOR AND APPARATUS OF PRODUCING OUTER MEMBER OF UNIVERSAL JOINT HAVING CROSS-GROOVES

FIELD OF THE INVENTION

The present invention relates to a method for and an apparatus of producing an outer member of a universal joint having cross-grooves. In particular, the invention relates to a method for and an apparatus of producing such an outer member by means of an ironing operation wherein the outer member is pushed into a die bore in a direction opposite to that in prior art, so as to increase replenishability of the inner peripheral portion of the outer member.

BACKGROUND OF THE INVENTION

An outer member 1 of a universal joint having cross-grooves includes, as shown in FIG. 7(B), a shank 1*a*, and a cylindrical portion 1*b* being integral therewith and having an inner peripheral surface. A plurality of track grooves 2 are formed in the inner peripheral surface of the cylindrical portion. The track grooves 2 are inclined a predetermined angle relative to the axial direction of the outer-member 1, so as to be crossed relative to one another. A cage and a plurality of balls (both are not shown in the drawing) are assembled to the outer member 1, so as to form a constant-velocity universal joint.

The outer member 1 of a universal joint or joint is produced by means of an ironing process which is a kind of cold workings. The ironing process was conventionally performed first by applying a surface lubrication treatment, such as a phosphating treatment, to a surface of a preformed material having been formed into the configuration (the track grooves are not formed) substantially as shown in FIG. 7(B) by means of a sub-hot forging. Then, a punch set 5 is fitted within the cylindrical portion 1*b*, as shown in FIG. 7(A). The punch set 5 includes, at its forward end, a plurality of segments 4 expandable and constrictable in the radial direction each on which a protrusion 3 corresponding to a ball-rolling-groove is provided. An expander shaft 7 is pressed into a central bore 6 of the punch set, so that the segments 4 are expanded in the radial direction. By this, the segments 4 are urged against the inner peripheral surface of the cylindrical portion 1*b*. With this condition, the preformed material is pushed into a die bore 8 starting with its shank 1*a* (i.e., the shank 1*a*, rather than the cylindrical portion 1*b*, is first inserted into the die bore 8), so as to perform ironing operation relative to the outer peripheral surface of the cylindrical portion 1*b* by means of a reduced bore 8*a* of the die bore 8. Thus, the inner peripheral surface of the cylindrical portion 1*b* is pressed against the segments 4, whereby track grooves 2 of a predetermined configuration are formed. Then, the expander shaft 7 is withdrawn from the central bore 6 of the punch set 5, so as to cause the segments 4 to be constricted. Thereafter, the outer member 1 is removed or withdrawn from the die bore 8.

In prior art production method, the outer member 1 is gradually depressed by the punch set 5 so as to perform an ironing operation relative to the cylindrical portion 1*b*, as shown in FIG. 7(A). Thus, the cylindrical portion 1*b* experiences a material flow in the radially inward direction, as well as a material flow in the axial direction toward the opening portion 9 of the cylindrical portion 1*b*. The latter material flow tends to cause reduction in wall thickness in the areas T indicated by cross-hatching in FIG. 7(B), i.e., the areas defined between the lower ends of the adjoining track grooves which are disposed between the protrusions 3 of the segments 4, so as to have relatively limited area, and thus less capable of causing a material flow during ironing operation. When wall thickness is reduced, the adjoining track grooves are adversely influenced, so that dimensional accuracy of the grooves 2 is decreased. Recesses are formed in the outer and inner surfaces of the outer member 1, thus degrading the appearance and strength of the resultant products.

SUMMARY OF THE INVENTION

Accordingly, a main object of the invention is to provide a method for and an apparatus of producing an outer member of a universal joint or joint having cross-grooves, which-increase replenishability of the inner peripheral portion of the outer member, which increase dimensional accuracy of the track grooves, and which prevent reduction in wall thickness of the outer member.

In order to solve the above problems, the present invention provides a method for producing an outer member of a universal joint having cross-grooves, the outer member being provided as a preformed material including a shank and a cylindrical portion formed at one end of the shank, the method comprising the steps of: fitting a punch set within the inner periphery of the cylindrical portion, the punch set being expandable and constrictable and including a plurality of protrusions having a configuration complementary to that of the cross-grooves to be formed in the inner periphery of the cylindrical portion; and pressing the cylindrical portion into a die bore, starting with an opening portion thereof, so as to perform an ironing operation relative to the outer member.

In accordance with the invention, the direction in which ironing operation is performed relative to the cylindrical portion is the reverse of the prior art. Thus, a force is applied in a direction whereby the wall thickness of the cylindrical portion in its entirety is increased. Accordingly, replenishability of the inner peripheral portion of the cylindrical portion may be increased.

Since force is applied in a direction whereby the wall thickness of the cylindrical portion in its entirety is increased, as mentioned above, replenishability of the inner peripheral portion of the cylindrical portion may be further increased by a simple construction. Specifically, the replenishability of the inner peripheral portion may be further increased by causing the cylindrical portion to be pressed in the radially inward direction from the outside of the protrusions of the punch set by means of depressed protrusions formed in the outer peripheral surface of the cylindrical portion and/or depressing portions formed in the inner peripheral surface of the die bore.

In order to achieve the above object, the invention also provides an apparatus of producing an outer member of a universal joint having cross-grooves, the outer member being provided as a preformed material including a shank and a cylindrical portion formed at one end of the shank, by fitting a punch set within the inner periphery of the cylindrical portion, the punch set being expandable and constrictable and including a plurality protrusions having a configuration complementary to that of the cross-grooves to be formed in the inner periphery of the cylindrical portion; and pressing the cylindrical portion into a die bore, starting with an opening portion thereof, so as to perform an ironing operation relative to the outer member.

In the above apparatus, for the purpose of further increasing the replenishability of the inner peripheral portion of the cylindrical portion;

(1) first recesses are formed in the inner peripheral surface of the cylindrical portion, each of the first recesses comprehensively including a predetermined area in which a ball-rolling-groove constituting a respective cross-groove is formed, and extending in the direction opposite to the direction of inclination of the track grooves and spreading generally in sector-like configuration toward the opening portion of the cylindrical portion; first depressed protrusions are formed in the outer peripheral surface of the cylindrical portion in an area radially corresponding to the extension portion of each of the first recesses; and first depressing portions, for pressing the first depressed protrusions, are formed in the inner peripheral surface of the die bore;

(2) a second depressing portion is formed in the inner peripheral surface of the die bore in an area corresponding to a predetermined area in which two adjoining track grooves constituting each of the cross-grooves are formed; and (3) a third recess is formed in the inner peripheral surface of the cylindrical portion in a predetermined area in which adjoining two track grooves constituting the cross-groove are formed, each of the third recesses comprehensively including the predetermined area and spreading in a sector-like configuration toward the opening portion of the cylindrical portion; a third depressed protrusion is formed in the outer peripheral surface of the cylindrical portion in an area corresponding to each of the third recesses in the radial direction; and a third depressing portion is formed in the inner peripheral surface of the die bore for urging each of the third depressed portions at its center.

In order to further increase the replenishability of the inner peripheral portion of the cylindrical portion, the above (1) to (3) may be suitably combined. In each construction, the direction in which the outer member is pressed into the die bore is the reverse of the prior art. By this, a force is applied in the direction in which the wall thickness of the cylindrical portion may be increased. Furthermore, the above force for increasing the wall thickness is increased in the radially inward direction, due to the provision of the depressed portions and/or the depressing portions. Accordingly, replenishability of the inner peripheral portion of the cylindrical portion is further increased.

BRIEF DESCRIPTION OF THE DRAWINGS

For a fuller understanding of the nature and objects of the present invention, reference should be had to the following detailed description taken in connection with the accompanying drawings wherein:

FIG. 1(A) is a vertical, cross-sectional view illustrating an outer member of a universal joint according to one embodiment of the invention during an ironing process, and FIGS. 1(B) and (C) are perspective views respectively illustrating outer members according to another embodiments of the invention;

DETAILED DESCRIPTION OF THE PREFERRED EMBODIMENTS

Figure 2:
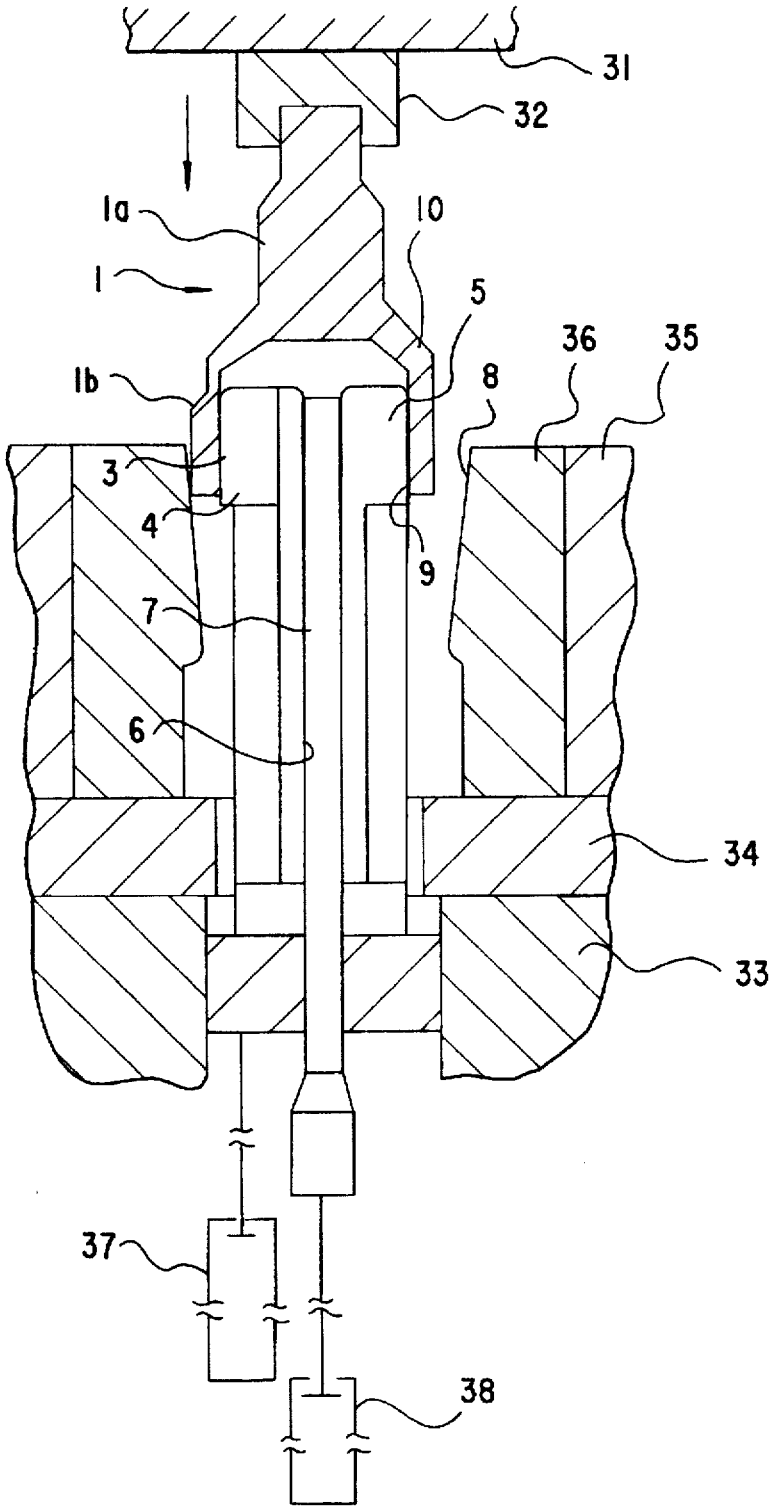
FIG. 2 is a vertical, cross-section showing a press machine for ironing an outer member.

Several embodiments of the invention will be explained below with reference to the drawings. In accordance with the invention, an outer member 1, in the form of a phosphated, performed material, is drawn into a die bore 8 in a direction opposite to that of the prior art, as shown in FIG. 1. Specifically, an opening portion 9 of a cylindrical portion **1*b* is first pushed into the die bore 8**. The remaining construction is basically the same as that of the prior art.

In accordance with the method according to the invention, a material flow (displacement of the material constituting the cylindrical portion of the outer member during ironing operation) is caused in a direction from the opening portion 9 toward the proximal portion 10, which is opposite to that in prior art wherein a material flow is caused from the proximal portion 10 toward the opening portion 9. By this the wall thickness between the track grooves (grooves adapted to receive therein a rolling ball) will not be decreased. Moreover, a material flow may be caused which increases the wall thickness of the cylindrical portion **1*b* in its entirety. Thus, the inner peripheral surface of the cylindrical portion 1*b* is more strongly pressed against the segments 4, whereby dimensional accuracy of the track grooves 2** may be increased.

The replenishability of the inner peripheral portion of the cylindrical portion **1*b* may be increased over the prior art, even when the outer peripheral surface of the cylindrical portion 1*b* of the preformed material and the inner peripheral surface of the die bore 8 are in a cylindrical configuration having no irregularities. It is noted, however, that such replenishability of the inner peripheral portion may be further increased. FIGS. 1(B) and (C) and FIGS. 3**(A) and (B) illustrate other embodiments for increasing the replenishability of the inner peripheral portion.

More specifically, and according to the embodiment shown in FIG. 1(B), first recesses 21, in the form of a sector slightly larger than the ball-rolling-grooves 2, are formed in the inner peripheral surface of the cylindrical portion **1*b* at a preforming stage. The first recesses 21 comprehensively includes a predetermined area in which each of the ball-rolling-grooves 2 are to be formed. The first recesses 21 extend in the cross-hatched area P in a direction opposite to the direction of inclination of the track grooves 2 and also extend generally in a sector toward the opening portion 9 of the cylindrical portion 1*b*. In the outer peripheral surface of the cylindrical portion 1*b* at areas corresponding to the above areas P of the first recesses 2, first depressed protrusions 22 for crushing the areas P are formed. Each of the first depressed protrusions 22 is pressed by the inner peripheral surface of the die bore 8 so as to cause a material flow in a radially inner direction, during the ironing process. By this, each area P is completely crushed, so that the inner peripheral portion of the cylindrical portion 1*b* is completely pressed against the protrusions 3 of the segments 4. This, together with the thickening effect relative to the cylindrical portion 1*b* in its entirety, further contributes to an increase in dimensional accuracy of the track grooves. The inner peripheral surface of the die bore 8 may form first depressing portions for depressing the first depressed protrusions 22, even when the inner peripheral surface is in a cylindrical configuration as in the prior art. It is noted, however, that protrusions in the inner peripheral surface of the die bore may be formed at positions corresponding to the first depressed protrusions, so that the first depressed protrusions 22** are pressed more strongly.

FIG. 1(C) shows an outer member 1 as a product which includes second depressing portions (not shown) in a form of a sector formed in the inner peripheral surface of the die bore 8. The second depressing portions are protrudingly formed in the inner peripheral surface of the die bore 8 in the areas of a sector corresponding to predetermined areas in which adjoining track grooves 2, constituting a cross-groove in the inner peripheral surface of the cylindrical portion 1*b*, are formed. In this embodiment, each of the second depressing portions urges the cylindrical portion 1*b* in a radially inner direction during ironing process. Thus, dimensional accuracy of the track grooves 2 are further increased, as in the case of FIG. 1(E). It is noted that recesses 23 of a sector configuration are remained as a trace in the outer peripheral surface of the cylindrical portion 1*b*, since each of the second depressing portions urge the cylindrical portion 1*b* in a radially inner direction.

Figure 3A:
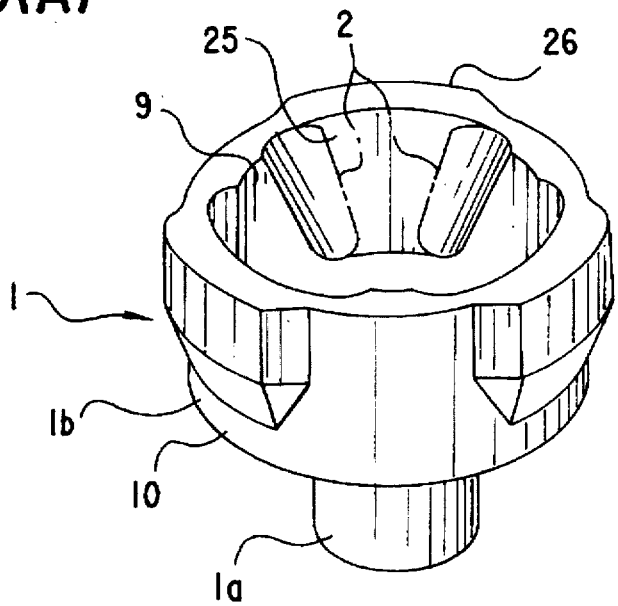
FIG. 3(A) is a perspective view illustrating an outer member according to another embodiment of the invention.
Figure 3B:
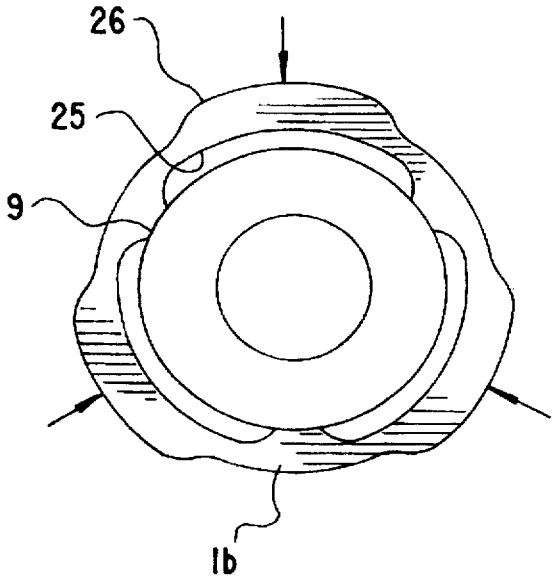
FIG. 3(B) is a top plan view of the outer member of FIG. 3(A)

FIG. 3(A) and (B) show another embodiment in which third recesses 25 are formed in the inner peripheral surface of the cylindrical portion 1*b*, and third depressed protrusions 26 are formed in the outer peripheral surface of the cylindrical portion 1*b*. More specifically, each of the third recesses 25 is formed in a predetermined area in which adjoining two track grooves 2, constituting a cross-groove, are formed. Each of the third recesses 25 comprehensively includes the above predetermined area and extends in a sector-like configuration toward the opening portion 9 of the cylindrical portion 1*b*. The third depressed protrusions 26 are formed in areas corresponding to the third recesses 25 in the radial direction. In this embodiment, the third depressed protrusions 26 of the cylindrical portion 1*b* are pressed by the inner peripheral surface of the die bore 8, during ironing operation. This causes material flow toward a space between the predetermined areas in which the track grooves 2 of the third recesses 25 are formed. Thus, the track grooves are precisely formed as in the case of the remaining embodiments. The inner peripheral surface of the die bore 8 may form the third depressing portions for depressing the third depressed protrusions 26, even when the inner peripheral surface of the die bore 8 is of a cylindrical configuration as in prior art. It is noted, however, that the portion corresponding to each of the third depressed protrusions 26 in the inner peripheral surface of the die bore 8 may be formed into a protrusion, so that the third depressed protrusions 26 are depressed more strongly.

FIG. 2 is a vertical, cross-sectional view schematically illustrating an apparatus to be used in the method for producing an outer member according to the invention. A shaft 1*a* of a preformed material is secured to an upper press ram 31 through a jig 32. A die holder 35 is fixed to a lower press ram 33 through a die plate 34. A die 36 is disposed within the die holder 35. The lower press ram 33 includes a punch set 5 movable in the vertical direction by means of a first cylinder 37, and an expander shaft 7 movable in the vertical direction by means of a second cylinder 38. The punch set 5 extends upwardly through a die bore 8. The expander shaft 7 is removably press-fitted into a central bore 6 of the punch set 5. FIG. 2 illustrates an ironing process in which the punch set 5, having been expanded by the press-fit of the expanded shaft 7 into a cylindrical portion 1*b*, is displaced downwardly together with the cylindrical portion 1*b* by means of the upper press ram 31. As explained in the above, a material flow from an opening portion 9 toward a proximal portion 10 is initiated, simultaneously when the cylindrical portion 1*b* is radially drawn by means of the inner peripheral portion of the die bore 8, whereby the replenishability of the inner peripheral portion of the die bore may be increased.

Figure 4:
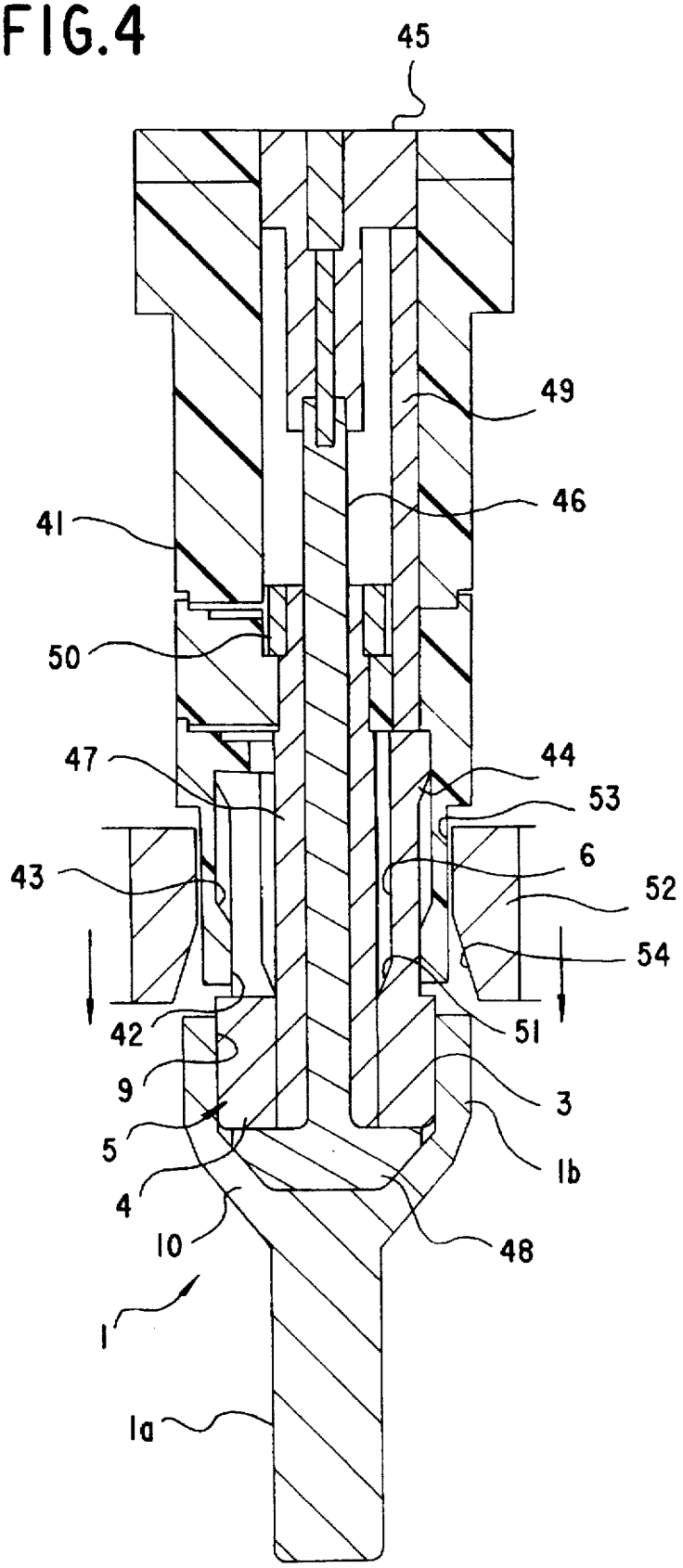
FIG. 4 is a vertical, cross-sectional view showing another press machine for ironing an outer member.

FIG. 4 is a vertical, cross-sectional view schematically showing another apparatus to be used in the method for producing an outer member in accordance with the invention. With the apparatus shown in FIG. 2, the segment 4 only becomes free in the radial direction, but is not forcibly constricted, when the expander shaft 7 is withdrawn from the central bore 6 of the segment 4. The apparatus shown in FIG. 4 differs from the apparatus shown in FIG. 2 in that the segment 4 may be forcibly expanded or constricted by engagement or disengagement of an expander shaft 47 relative to the central bore 4 of the segment 4. Specifically, the apparatus shown in FIG. 4 is designed so as to forcibly cause expansion, as well as constriction, of the segment 4. The apparatus will be In FIG. 4, reference numeral 41 designates a vertical sleeve fixedly connected, at its upper end, to a machine frame (not shown). The upper end portion of the segment 4 of the punch set 5 is received in a lower opening 42 of the vertical sleeve 41 for vertical movement. The vertical sleeve 41 is formed, in the inner peripheral portion at its lower end, with an inclined portion (pressing portion) 43 for constricting the segment 4. Thus, the lower opening 42 of the vertical sleeve 41 is slightly narrowed.

Figure 5C:
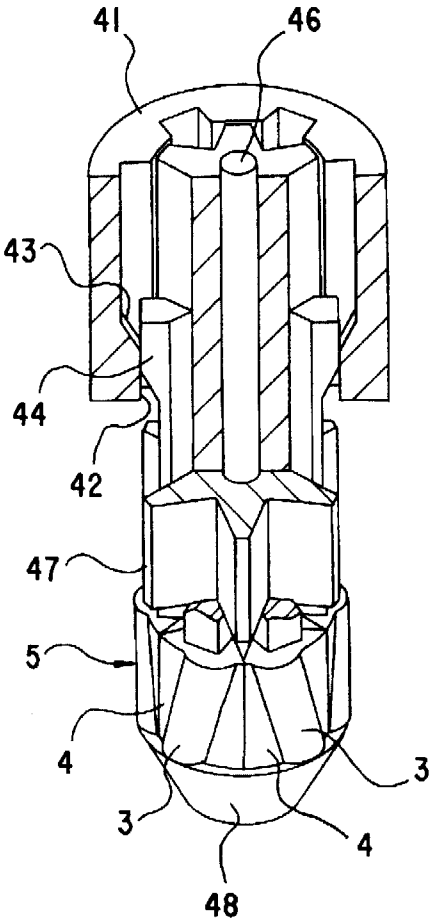
FIGS. 5(A) to (C) are perspective views showing a punch set in various positions.
Figure 5B:
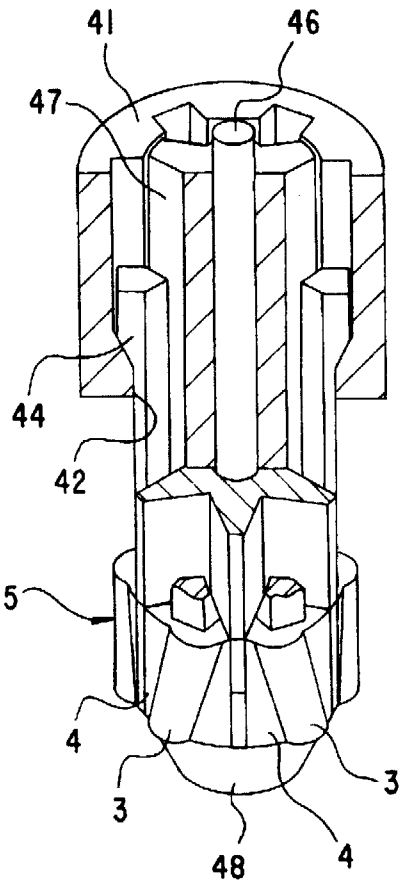
Figure 5A:
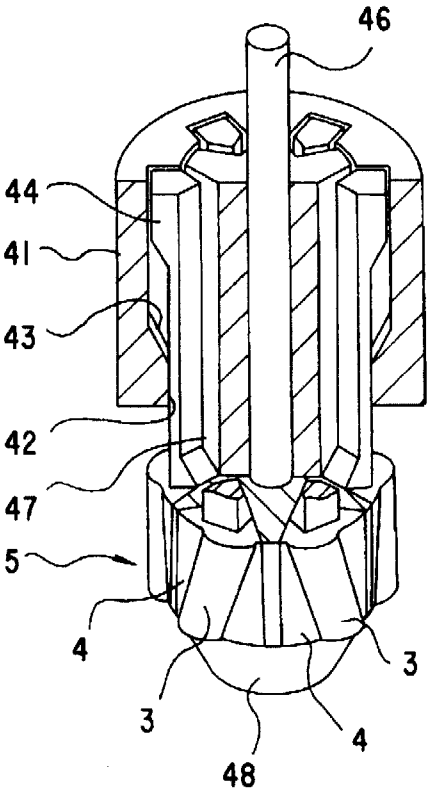

The segment 4 of the punch set 5 is divided into six portions in the circumferential direction, as shown in FIGS. 5(A) to (C). A protrusion 3 is formed in the outer periphery of the lower end of each of the segments 4. Each protrusion 3 has a configuration complementary to that of the cross-grooves. The outer periphery of the upper end of each of the segments 4 is formed with a protrusion (second pressed portion) 44 to be guided by the inclined portion 43 of the vertical sleeve 41.

A piston 45 is disposed within the vertical sleeve 41 for vertical movement. The piston 45 is adapted to be connected to a vertically movable ram (not shown) and to be driven thereby. A hanging rod 46 is connected to the piston 45 at its lower end portion. The hanging rod 46 extends through the central bore 6 of the segment 4. The hanging rod 46 is integrally formed, at its lower end portion, with a disk-shaped portion 48. The lower end surface of the segment 4 is supported by the disk-shaped portion 48. The piston 45 is also connected with an upper end portion of each of push-down rods (extruding members) 49. The number of push-down rods is the same as that of the segments i.e., six (only one of the push-down rods is shown in FIGS. 4 and 6). A lower end portion of each of the push-down rods is engaged with the upper end portion of each of the segments 4.

An expander shaft 47 is slidably fitted around the hanging rod 46. An upper end portion of the expander shaft 47 is connected to a vertical sleeve 41 by means of a nut 50. A lower end portion of the expander shaft 47 extends into the central bore 6 of the punch set 5. The inner peripheral surface defined by the segments 4 is formed with an inclined portion 51 (a first depressed portion), so that the central bore 6 is tapered downwardly. Thus, the segments are expanded when the inclined portion 51 is pressingly urged by the lower end of the expander shaft 47.

A die 52 is fitted over the vertical sleeve 41 for vertical movement. The die 52 includes a die bore 53 having a diameter slightly smaller than the outer diameter of the cylindrical portion 1b of the outer member 1 of the preformed material. The lower half of the die bore 53 defines a tapered surface 54 which diverges downwardly.

Figure 6E:
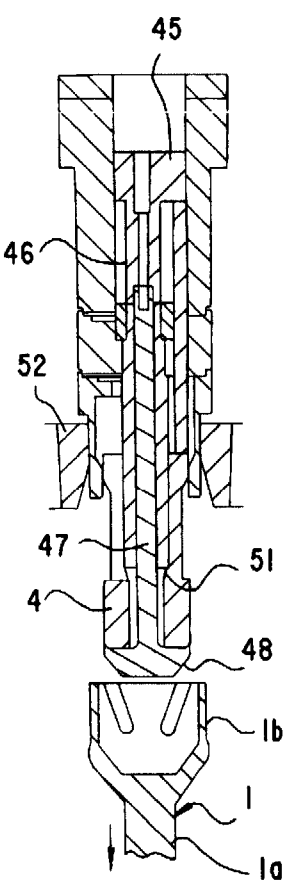
FIGS. 6(A) to (B) are cross-sectional views illustrating the ironing process in sequence.
Figure 6D:
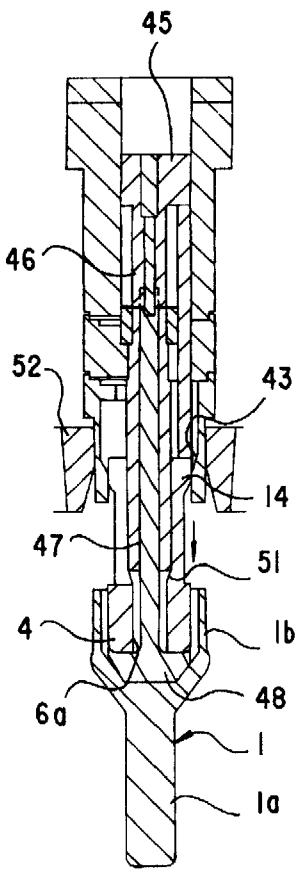

In the apparatus constructed as mentioned above, the vertical sleeve 41 and the expander shaft 47 are not movable in the vertical direction, while the piston 45, the hanging rod 46 and the punch set 5 are integrally moved in the vertical direction. When the punch set 5 is moved up and down, the segments 4 are expanded and constricted, respectively, due to the operation of the expander shaft 47 and the inclined portion 43. FIGS. 5(A) to (C) illustrate the manner in which the segments 4 are constricted in response to gradual downward movement of the punch set 5. When an outer member of a universal joint is produced using the above mentioned apparatus, the piston 45 is first moved downwardly, i.e., the segment 4 is constricted, as shown in FIGS. (D) and (E). Under this condition, the cylindrical portion 1b of the outer member 1 of a preformed material is freely fitted around the punch set 5. It is noted that, at this stage, the ironing process has not yet been initiated, so that the cylindrical portion 1b in FIG. 6(D) is considered to be replaced with the cylindrical portion 1b prior to the ironing process shown in FIG. 6(A).

Figure 6C:
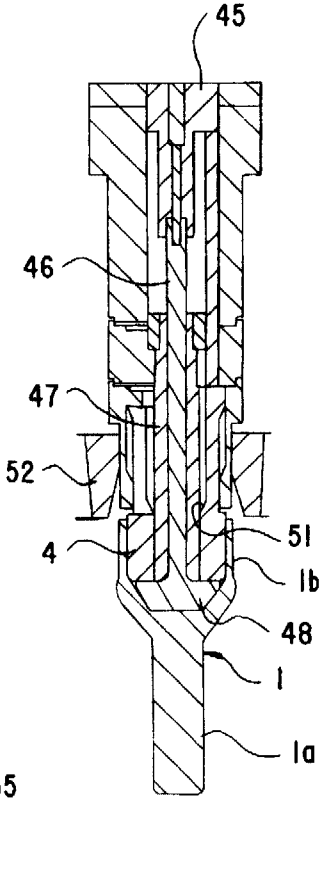
Figure 6B:
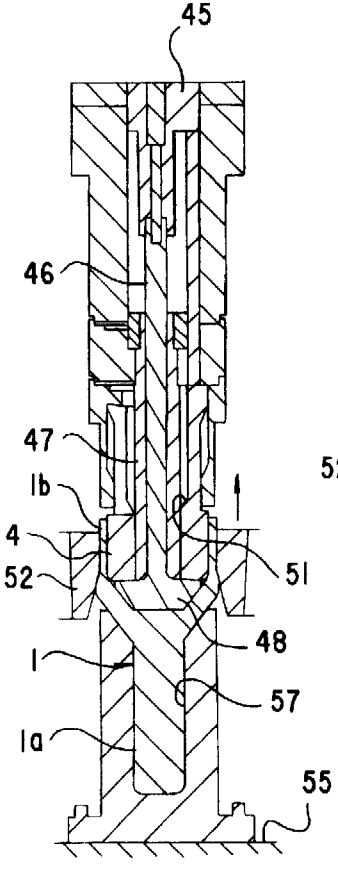
Figure 6A:
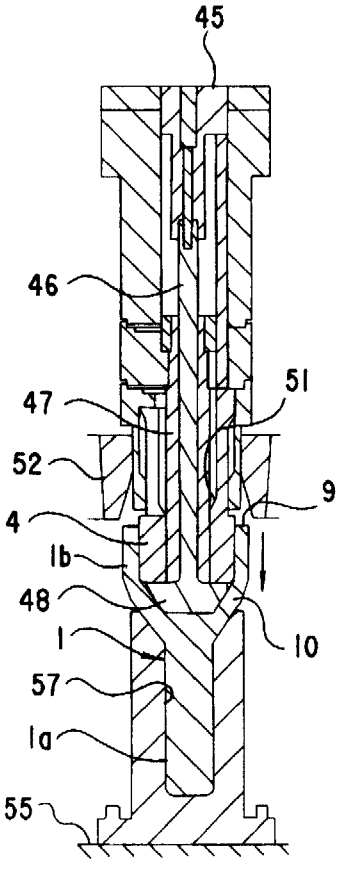
Figure 7A:
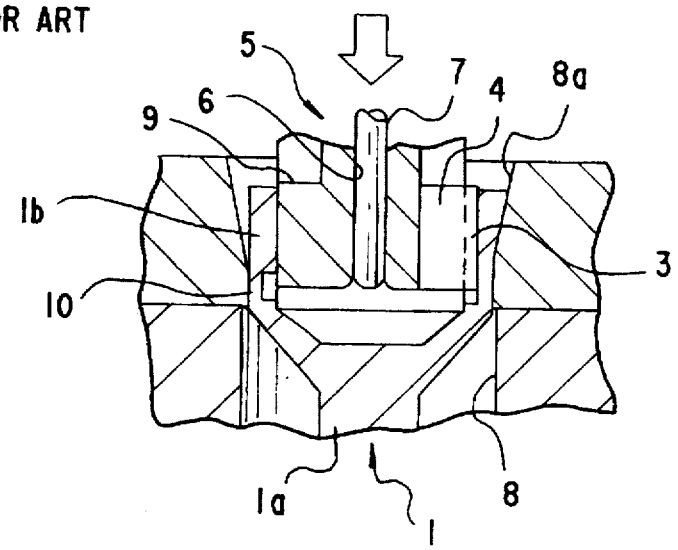
FIG.7(A) PRIOR ART
FIG. 7(A) is a vertical, sectional view illustrating an outer member of a prior art universal joint during ironing process.
Figure 7B:
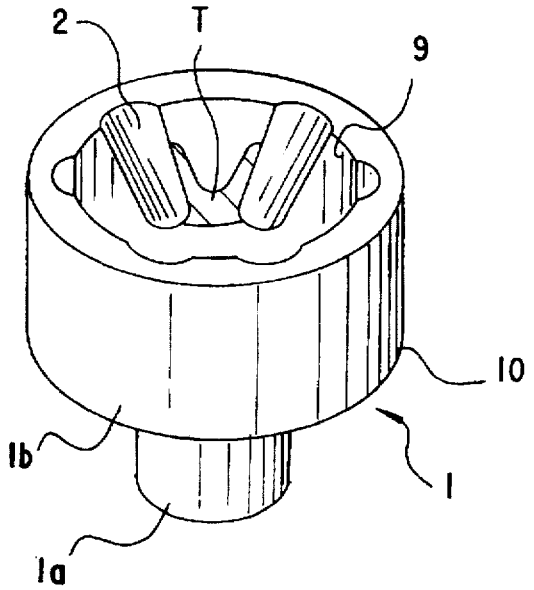
FIG.7(B) PRIOR ART
FIG. 7(B) is a perspective view illustrating a thin-walled area T of a prior art outer member.

Then, the piston 45 is moved upwardly so as to raise the segments 4 upwardly by means of the disk-shaped portion 48, as shown in FIG. 6(A). Thus, the lower end portion of the expander shaft 47 is pressingly fitted into the central bore 6 of the segments 4 so as to cause the segments 4 to be expanded, whereby the protrusion 3 of each of the segments 4 is pressingly engaged with the inner peripheral surface of the cylindrical portion 1b. In this condition, the shaft 1a of the outer member 1 is fitted in a bore 57 of a cylindrical jig 56 fixed to a base 55 and fixed there. Then, the die 52 is moved downwardly so as to perform an ironing operation relative to the outer peripheral surface of the cylindrical portion 1b. Thus, the cylindrical portion 1b is drawn in a radially inward direction by means of the inner peripheral surface of the die bore 53. At the same time, a material flow is caused in the direction from the opening portion 9 of the cylindrical portion 1b toward the proximal end portion 10. By this, replenishability of the inner peripheral portion of the cylindrical portion 1b is increased, and cross-grooves complementary to the configuration of the protrusion 3 is formed in high accuracy.

When the cross-grooves have been formed in the cylindrical portion 1b, the die 52 is moved upwardly so as to be disengaged from the outer periphery of the cylindrical portion 1b, as shown in FIG. 6(C). Then, the piston 45 is moved downwardly, as shown in FIG. 6(D). When the piston 45 is moved downwardly, the segments 4 are pushed downwardly by means of the push-down rod 49 integral with the piston 45. By this, the expander shaft 47 is gradually withdrawn from the central bore 6 of the segments 4 in the upward direction. Simultaneously when the lower end of the expander shaft 47 is withdrawn from a reduced portion 6a of the central bore 6, the protrusion 44 at the upper end of each of the segments 4 is raised upon the inclined portion 43 of the vertical sleeve 41, so that the segments 4 are constricted by the guide effect of the inclined portion 43, as shown in FIGS. 6(D) and (E). By this, a gap is formed as between the outer peripheral surface and tie protrusions, and as between the inner peripheral surface of the cylindrical portion 1b and the cross-grooves. Accordingly, the cylindrical portion 1b may be withdrawn downwardly, without causing any interference with the segments 4. Thus, the cross-grooves, having been formed with high accuracy, may be smoothly removed from the punch set 5, without causing any damage thereto due to interference with the segments 4.

In the above embodiment, only the inclined portion 43 is provided for the purpose of constricting the segments 4. It is noted, however, that the forward end portion of the expander shaft 47 may be magnetized, so that the inner surface of each of the segments 4 or the inner peripheral surface of the central bore 6 of the punch set 5 is always magnetically absorbed to the outer peripheral surface of the expander shaft 47. By this, it is possible for the segments 4 to be constricted, without provision of the inclined portion 43 and the protrusion 44.

ADVANTAGES OF THE INVENTION

As described in the above, the cylindrical portion of the outer member is pushed into the die bore of the direction opposite to that of the prior art, so as to perform air ironing operation. This causes a material flow in the cylindrical portion in the direction in which the wall thickness thereof may be increased, whereby replenishability of the inner peripheral portion of the cylindrical portion may be increased. This increases dimensional accuracy of the track grooves, as well as strength of the cylindrical portion.

The segments of the punch set is forcibly or compulsorily expanded or constricted. Thus, interference between the cross-grooves of the cylindrical portion and the segments may be prevented when the cylindrical portion of the outer member is removed from the punch set, whereby forming rate and production efficiency of the outer member are increased.

It will be obvious to those skilled in the art that many variations may be made in the above embodiments, here chosen for the purpose of illustrating the present invention, and full result may be had to the doctrine of equivalents without departing from the scope of the present invention, as defined by the appended claims.

We claim:

1. A method for producing an outer member of a universal joint having cross-grooves, the-outer member being provided as a preformed material including a shaft and a cylindrical portion formed at one end of the shaft, comprising the steps of:

fitting a punch set within an inner periphery of the cylindrical portion, the punch set being expandable and constrictable and including a plurality of protrusions having a configuration complementary to that of cross-grooves to be formed in the inner periphery of the cylindrical portion; and pressing the cylindrical portion into a die bore, starting with an opening portion thereof, so is to perform an ironing operation relative to the outer member, wherein the cylindrical portion is pressed in a radially inward direction from the outside at a location adjacent to the punch set protrusions by means of protrusions formed in the outer peripheral surface of the cylindrical portion, which are pressed by an inner surface of the die bore.

2. A method for producing an outer member of a universal joint having cross-grooves, the outer member being provided as a preformed material including a shaft and a cylindrical portion formed at one end of the shaft, comprising the steps of: fitting a punch set within an inner periphery of the cylindrical portion, the punch set being expandable and constrictable and including a plurality of protrusions having a configuration complementary to that of the cross-grooves to be formed in the inner periphery of the cylindrical portion; and pressing the cylindrical portion into a die bore, starting with an opening portion thereof, so as to perform an ironing operation relative to the outer member such that the wall thickness of the cylindrical portion is increased.

3. A method for producing an outer member of a universal joint having cross-grooves according to claim 2 comprising the steps of:

forming first recesses in the inner peripheral surface of the cylindrical portion, each of the first recesses comprehensively including a predetermined area in which a track groove constituting a respective cross-groove is formed, and extending in a direction opposite to a direction of inclination of the track grooves and spreading generally in sector-like configuration toward the opening portion of the cylindrical portion;

wherein first depressed protrusions are formed in the outer peripheral surface of the cylindrical portion in an area radially corresponding to the extension portion of each of the first recesses; and wherein first depressing portions; for pressing the first depressed protrusions, are formed in the inner peripheral surface of the die bore.

4. A method for producing an outer member of a universal joint having cross-grooves according to claim 3 further comprising the steps of:

forming a second depressing portion in the inner peripheral surface of the die bore in an area corresponding to a predetermined area in which two adjoining track grooves constituting each of the cross-grooves are formed at both sides.

5. A method for producing an outer member of a universal joint having cross-grooves according to claim 3 further comprising the steps of:

forming a third recess in the inner peripheral surface of the cylindrical portion in a predetermined area in which two adjoining track grooves constituting the cross-groove are formed, each of the third recesses comprehensively including the predetermined area and spreading in a sector-like configuration toward the opening portion of the cylindrical portion;

wherein a third protrusion is formed in an outer peripheral surface of the cylindrical portion in an area corresponding to each of the third recesses in the radial direction; and wherein a third depressing portion is formed in an inner peripheral surface of the die bore for urging each of the third depressed portions at its center.

6. An apparatus for producing an outer member of a universal joint having cross-grooves, the outer member being provided as a preformed material including a shaft and a cylindrical portion formed at one end of the shaft, the apparatus comprising:

a die having a die bore for receiving by pressure therein the cylindrical portion of the preformed material from its opening portion, so as to perform an ironing operation;

a punch set including a plurality of segments which are expandable and constrictable in the radial direction, each of the segments having at a forward end a protrusion having a configuration complementary to that of the cross-grooves;

a first depressed portion formed in an inner peripheral surface of each of the segments of the punch set;

a second depressed portion formed in an outer peripheral surface of each of the segments of the punch set;

an expander shaft adapted to be pressed into a central portion of the punch set for urging the first depressed portions in a radially outward direction, so as to cause the segments to be expanded;

a displacer member for displacing the punch set having the expander shaft pressed thereinto at its center in a direction toward a forward end of the expander shaft; and a depressing portion for urging the second depressed portion of each of the segments, so as to cause the segments to be constricted, when the punch set is displaced from the expander shaft and when a forward end of the expander shaft is withdrawn to the first depressed portion of each of the segments.

* * * * *